US005387291A

United States Patent [19]

Kaneko et al.

[11] Patent Number: 5,387,291

[45] Date of Patent: Feb. 7, 1995

[54] PROCESS FOR PRODUCING ALLOY POWDER MATERIAL FOR R-FE-B PERMANENT MAGNETS AND ALLOY POWDER FOR ADJUSTING THE COMPOSITION THEREFOR

[75] Inventors: Yuji Kaneko, Uji; Koki Tokuhara, Otsu, both of Japan

[73] Assignee: Sumitomo Special Metals Co., Ltd., Osaka, Japan

[21] Appl. No.: 32,101

[22] Filed: Mar. 17, 1993

[30] Foreign Application Priority Data

Mar. 19, 1992 [JP] Japan ..... 4-093779
Apr. 8, 1992 [JP] Japan ..... 4-116977

[51] Int. Cl.[6] ..... H01F 1/02
[52] U.S. Cl. ..... 148/101; 148/105
[58] Field of Search ..... 148/101, 104, 105, 302; 75/255; 420/83, 121

[56] References Cited

U.S. PATENT DOCUMENTS 4,975,213 12/1990 Sakai et al. ..... 148/302
5,011,552 4/1991 Otsuka et al. ..... 148/302
5,049,203 9/1991 Mukai et al. ..... 148/104

FOREIGN PATENT DOCUMENTS 61-81603 4/1986 Japan ..... 148/302
62-102504 5/1987 Japan ..... 148/101

*Primary Examiner*—John P. Sheehan
*Attorney, Agent, or Firm*—Watson, Cole, Grindle & Watson

[57] ABSTRACT

A process for producing a starting powder material for use in the fabrication of high performance R—Fe—B permanent magnets comprising an $R_2Fe_{14}B$ compound as the principal phase, which is characterized by adding 70% by weight or less of a specified alloy powder for adjusting the composition comprising an $R_2Fe_{17}$ compound to a specified principal phase R—Fe—B alloy powder comprising an $R_2Fe_{14}B$ compound as the principal phase. This process enables production of a starting alloy powder material considerably reduced in contents of the unfavorable B-rich and R-rich phases which impair the magnetic properties of the final magnet, because the starting powder blend allows the B-rich and R-rich compounds in the principal phase alloy powder to react with the $R_2Fe_{17}$ compound being incorporated in the alloy powder for adjusting the composition.

19 Claims, No Drawings

PROCESS FOR PRODUCING ALLOY POWDER MATERIAL FOR R-FE-B PERMANENT MAGNETS AND ALLOY POWDER FOR ADJUSTING THE COMPOSITION THEREFOR

FIELD OF THE INVENTION

The present invention relates to a process for producing a starting powder material for fabricating an R—Fe—B permanent magnet containing R (R represents at least one selected from rare earth elements inclusive of yttrium (Y)), Fe (iron) and B (boron). More particularly, the present invention relates to a process for producing an alloy powder for use as the starting powder material for an R—Fe—B based permanent magnet (which may sometimes be referred to simply hereinafter as "the starting powder material") comprising a principal phase alloy powder, i.e, a powder of an $R_2Fe_{14}B$ principal phase, having added therein an adjusting alloy powder, i.e., a powder containing an $R_2Fe_{17}$ phase, and reduced in concentration of unfavorable phases which impair the magnetic properties the resulting magnet, e.g., a B-rich phase and an R-rich phase. The present invention also relates to an alloy powder for controlling the composition thereof.

BACKGROUND OF THE INVENTION

An R—Fe—B permanent magnet is a representative of the high performance permanent magnets known at present. The excellent magnetic characteristics of an R—Fe—B permanent magnet as disclosed in JP-A-59-46008 (the term "JP-A-" as used herein signifies "an unexamined published Japanese patent application") is attributed to the composition comprising a tetragonal ternary compound as the principal phase and an R-rich phase. The R—Fe—B permanent magnet above yields an extraordinary high performance, i.e., a coercive force iHc of 25 kOe or higher and a maximum energy product (BH)max of 45 MGOe or higher, as compared with the conventional high performance rare earth-cobalt based magnets. Furthermore, a variety of R—Fe—B based permanent magnets varied in composition are proposed to meet each of the particular demands.

To fabricate various types of R—Fe—B based permanent magnets as mentioned hereinbefore, an alloy powder having a predetermined composition should be prepared at first. The alloy powder can be prepared by an ingot-making and crushing process as disclosed in JP-A-60-63304 and JP-A-119701, which comprises melting the starting rare earth metal materials having subjected to electrolytic reduction, casting the melt in a casting mould to obtain an alloy ingot of a desired magnet composition, and then crushing the ingot into an alloy powder having the desired granularity. Otherwise, it can be prepared by a direct reduction diffusion process as disclosed in JP-A59-21940 and JP-A-60-77943, which comprises directly preparing an alloy powder having the composition of the desired magnet from the starting materials such as rare earth metal oxides, iron powder and Fe—B alloy powder.

The ingot-making and crushing process involves many steps, and, moreover, it suffers segregation of an R-rich phase and crystallization of iron (Fe) primary crystals at the step of casting the alloy ingot. According to this process, however, an alloy powder containing relatively low oxygen can be obtained, since the ingot can easily be prevented from being oxidized in a coarse grinding (primary crushing).

The direct reduction diffusion process, on the other hand, is advantageous as compared with the ingot-making and crushing process above in that the steps such as melting and coarse grinding can be omitted from the process of preparing the starting alloy powder for the magnet. However, as compared to the R-rich phases in the former process, the R-rich phases being formed by this process are smaller and well dispersed, and are mostly developed at the surroundings of the principal $R_2Fe_{14}B$ phase. The R-rich phase thus formed in this process is susceptible to oxidation, which, as a result, takes up a considerable amount of oxygen. In some kinds of magnet composition, the rare earth metal elements may be oxidized and consumed by the excess oxygen, and an unstable magnet characteristics may result therefrom.

It can be seen that the oxygen incorporated in the alloy powder deteriorates the magnet characteristics of an R—Fe—B permanent magnet. Accordingly, with an aim to reduce the content of the unfavorable oxygen of the alloy powder, the present inventors have proposed previously, as disclosed in Japanese patent application No. 02-229685, a process which comprises first preparing an alloy powder having a composition near to that of the $R_2Fe_{14}B$ phase by direct reduction diffusion process, while preparing separately a powder of intermetallic compounds such as an $R_2(Fe,Co)_{17}$ phase containing an $R_3Co$ phase (in which iron (Fe) may be present as a substitute for a part or a large part of Co) by adding metallic cobalt into the R-rich alloy powder, and then mixing them both to obtain an alloy material powder for an R—Fe—B permanent magnet.

The proposal above is extremely effective for reducing the oxygen content of the magnet and the starting powder material for an R—Fe—B permanent magnet, however, not only the principal $R_2Fe_{14}B$ phase but an R-rich phase and a B-rich phase, which are known also to deteriorate the intrinsic properties, remain in the magnet. It has been found extremely difficult to control precisely the content of these phases, and hence, these phases remain as the cause for destabilizing the magnetic characteristics.

SUMMARY OF THE INVENTION

An object of the present invention is to provide a process for producing various types of starting alloy powders for R—Fe—B permanent magnets in accordance with the desired magnet characteristics, which provides a magnet comprising magnetic phases increased in the principal $R_2Fe_{14}B$ phase but considerably reduced in B-rich and R-rich phases which are unfavorable for achieving a high performance magnet, and which also provides an alloy powder reduced in oxygen content.

The aforementioned object can be achieved by the present invention which provides a process for producing a starting alloy powder material for fabricating an R—Fe—B permanent magnet, characterized by that an alloy powder comprising an $R_2Fe_{17}$ phase for adjusting the composition and containing 50% by atomic or less of R (where R represents at least one selected from rare earth elements inclusive of yttrium) and balance iron (where at least one of cobalt and nickel may be present as a partial substitute for iron) with unavoidable impurities is added to a principal phase alloy powder which comprises an $R_2Fe_{14}B$ phase as the principal phase and containing from 10 to 30% by atomic of R (where R represents at least one of rare earth elements inclusive of yttrium), from 6 to 40% by atomic of boron, and balance iron (where at least one of cobalt and nickel may be present as a partial substitute for iron) with unavoidable impurities. The object above can be achieved also by an alloy powder newly provided for adjusting the composition of the starting alloy powder material for the R—Fe—B permanent magnet.

In the present invention, the alloy powder for adjusting the starting alloy powder material composition is preferably added at an amount of 70% by weight or less, and more preferably, from 0.1 to 40% by weight, with respect to the total weight of said starting alloy powder material.

Preferred amounts for the element R and boron in the principal phase alloy powder are from 12 to 20% by atomic and from 6 to 20% by atomic, respectively.

Preferably, iron (Fe) accounts for from 30 to 84% by atomic, and more preferably, from 60 to 82% by atomic, with respect to the principal phase alloy powder.

Allowable range of substitution of iron (Fe) in the principal phase alloy powder by cobalt (Co) is 10% by atomic or less, and that by nickel (Ni) is 3% by atomic or less.

Furthermore, when cobalt (Co) or nickel (Ni) partially substitutes for iron in the principal phase alloy layer, the preferred amount of iron (Fe) therein is in the range of from 17 to 84% by atomic.

In the alloy powder for adjusting the composition, R is preferably incorporated at an amount of from 5 to 35% by atomic, and iron (Fe) is preferably contained in an amount of from 65 to 95% by atomic.

Preferred amount of cobalt (Co) which can be incorporated in the alloy powder for adjusting the composition as a partial substitute for iron (Fe) is 10% by atomic or less. Preferred amount of nickel (Ni) and boron (B) as a partial substitute for iron (Fe) in the alloy powder for adjusting the composition are 3% by atomic or less, and 6% by atomic or less, respectively.

When boron (B) replaces a part of iron (Fe) in the alloy powder for adjusting the composition, the preferred content of iron (Fe) therein is from 59 to 89% by atomic.

The principal phase alloy powder and the alloy powder for adjusting the Composition for use in the present invention can be each prepared by a known ingot-making and crushing process or direct reduction diffusion process.

The present invention is described in detail below.

DETAILED DESCRIPTION OF THE INVENTION

It is known that R—Fe—B permanent magnets in general have particular textures comprising $R_2Fe_{14}B$ phase as a principal phase and a small amount of B-rich phase expressed by $R_{1.1}Fe_4B_4$, accompanied by R-rich phases at the grain boundaries thereof. It is also known that the magnetic properties are largely influenced by such textures.

When the boron (B) content in the R—Fe—B permanent magnet composition is less than 6% by atomic, an $R_2Fe_{17}$ phase forms within the magnet. Because this $R_2Fe_{17}$ intermetallic compound have its direction of easy magnetization in the crystallographic c-plane and a Curie point at the vicinity of room temperature, the formation thereof lowers the coercive force (iHc). When boron (B) is incorporated in the R—Fe—B permanent magnet in excess of 6% by atomic, on the other hand, it is known that the amount of B-rich phases is increased to lower the residual magnetization flux density (Br).

The present inventors have conducted extensively studies on the fabrication of sintered R—Fe—B permanent magnets. It has been found as a result that, by sintering an R—Fe—B alloy powder comprising an $R_2Fe_{14}B$ compound as a principal phase and having added therein a specified amount of an R—Fe alloy powder containing an $R_2Fe_{17}$ compound as an alloy powder for adjusting the composition, a liquid phase having a low melting point is formed through the eutectic reaction of the R component in the intergranular R-rich phase and the $R_2Fe_{17}$ phase in the R—Fe alloy powder at the vicinity of the eutectic point thereof, and that this low-melting liquid phase accelerates the sintering of the R—Fe—B alloy powder. Furthermore, it has been found that the $R_2Fe_{17}$ compound in the alloy powder for adjusting the composition and the B-rich and R-rich phases in the principal phase alloy powder undergo reaction during the sintering step to effectively increase the amount of the principal $R_2Fe_{14}N$ phase. The present invention has been accomplished based on these findings.

The present inventors have conducted experiments to find that, in a case using Nd as R, for instance, an Nd-rich phase undergoes a reversible reaction with an $Nd_2Fe_{17}$ compound at the vicinity of the eutectic point thereof, i.e., 690° C., to form a liquid phase. Accordingly, it has been found that this low-melting liquid phase accelerates the sintering of the principal phase Nd—Fe—B alloy powder.

Furthermore, it has been observed that the alloy powder comprising the $Nd_2Fe_7$ compound and the Nd—Fe—B alloy powder comprising $Nd_2Fe_{14}B$ compound undergo a chemical reaction expressed below during the sintering of the powder to effectively increase the amount of the principal $Nd_2Fe_{14}B$ phase within the sintered magnet.

$$\frac{13}{17}\,Nd_2Fe_{17} + \frac{1}{4}\,Nd_{1.1}Fe_4B_4 + \frac{133}{6800}\,Nd \rightarrow Nd_2Fe_{14}B$$

The reaction above reads that an $Nd_2Fe_{14}B$ compound is newly developed from the reaction between the $Nd_2Fe_{17}$ compound of the alloy powder for adjusting the composition and the B-rich $Nd_{1.1}Fe_4B_4$ compound of the principal Nd—Fe—B alloy powder. Accordingly, the B-rich phase and the Nd-rich phase, which were both unfavorable for a conventional process for fabricating a sintered permanent magnet from an alloy powder material comprising the principal $Nd_2Fe_{14}B$ phase alone, can be considerably reduced in content with respect to the principal phase by employing the process according to the present invention. Furthermore, it has been confirmed that the above reaction is not only observed for the case using Nd, but also for the case using any R, i.e., rare earth elements inclusive of Y.

As described above, the present invention provides a process for producing a starting alloy powder material for fabricating an R—Fe—B permanent magnet, characterized by that an alloy powder comprising an $R_2Fe_{17}$ phase for adjusting the composition and containing 50% by atomic or less of R (where R represents at least one selected from rare earth elements inclusive of yttrium (Y)) and balance iron (Fe) (where at least one of cobalt (Co) and nickel (Ni) may be present as a partial substitute for iron (Fe)) with unavoidable impurities is added at an amount of 70% by weight to a principal phase alloy powder which comprises an $R_2Fe_{14}B$ phase as the principal phase and containing from 10 to 30% by atomic of R (where R represents at least one of rare earth elements inclusive of yttrium (Y)), from 6 to 40% by atomic of boron (B), and balance iron (Fe) (where at least one of cobalt (Co) and nickel (Ni) may be present as a partial substitute for iron (Fe)) with unavoidable impurities.

In the present invention, both of the principal alloy powder comprising an $R_2Fe_{14}B$ compound as the principal phase and the alloy powder comprising an $R_2Fe_{17}$ compound for adjusting the composition can be prepared by a known ingot-making and crushing process or direct reduction diffusion process.

The addition of the alloy powder for adjusting the composition to the principal phase alloy powder comprising an $R_2Fe_{14}B$ phase containing specified amounts of R, iron (Fe), and boron (B) should be 70% by weight or less. If the addition is in excess of 70% by weight, the formation of the $R_2Fe_{14}B$ compounds having a uniaxial anisotropy is suppressed during the fabrication of an anisotropic magnet, which comprises sintering the starting powder material under a magnetic field. The resulting magnet then suffers weak orientation and hence a low residual magnetic flux density (Br). More preferably, the alloy powder for adjusting the composition is added at an amount of from 0.1 to 40% by weight to the principal phase alloy powder.

In the present invention, R represents rare earth elements comprising light rare earth and heavy rare earth elements inclusive of yttrium (Y). More specifically, R represent at least one element selected from a group consisting of Nd, Pr, La, Ce, Tb, Dy, Ho, Er, Eu, Sm, Gd, Pm, Tm, Yb, Lu, and Y. More preferably, R represents a light rare earth element such as Nd and Pr, or a mixture thereof. R may not be necessarily a pure rare earth element, but a one industrially available and contain impurities which are unavoidably incorporated during the production thereof.

Among the starting powder materials, the principal phase alloy powder comprising the principal $R_2Fe_{14}B$ compound must contain from 10 to 30% by atomic of an R. If the amount of R is less than 10% by atomic, residual Fe portions, into which R and boron (B) would not diffuse, increase within the alloy powder. If the amount of R exceeds 30% by atomic, the R-rich phase reversely increases to thereby increase the oxygen content. It is not possible to obtain favorable sintered permanent magnets in both cases. More preferably, the content of R is in the range of from 12 to 20% by atomic.

The boron (B) content in the principal phase powder alloy must be confined in the range of from 6 to 40% by weight. If boron (B) should be contained in the powder for less than 6% by atomic, the amount of the B-rich phase ($R_{1.1}Fe_4B_4$ compound) is too small to exhibit the aforementioned effect of the present invention even though an alloy powder for adjusting the composition were to be added. Then, the resulting permanent magnet suffers a low coercive force (iHc). If boron (B) is added by an amount exceeding 40% by atomic, an excess amount of B-rich phase forms to reversely reduce the formation of the principal $R_2Fe_{14}B$ phase. In this case, a favorable permanent magnetic properties inclusive of high residual magnetic flux density (Br) cannot be expected. More preferably, boron (B) is incorporated in the principal phase alloy powder at an amount in the range of from 6 to 20% by atomic.

The last component of the principal phase alloy powder, iron (Fe), is preferably included at an amount of from 20 to 86% by atomic. If the amount should be less than 20% by atomic, the amount of R-rich and B-rich phases relative to the principal compound becomes too high as to impair the magnetic properties of the permanent magnet. If the amount should exceed 86% by atomic, on the other hand, relative contents of rare earth elements and boron (B) are decreased as to increase the residual Fe portion. Then, a uniform alloy powder would not result due to the residual Fe portion being incorporated at a high ratio. A more preferred content of Fe is from 60 to 82% by atomic.

A partial substitution of iron (Fe) being incorporated in the principal alloy powder by at least one selected from cobalt (Co) and nickel (Ni) improves the corrosion resistance of the resulting magnet. However, an excess addition of those metal elements reversely lowers the coercive (iHc) of the iron (Fe) of the $R_2Fe_{14}B$ compound. Accordingly, cobalt (Co) and magnet due to the substitution which occurs on the constituent nickel (Ni) preferably account for an amount of 10% by atomic or less and of 3% by atomic or less, respectively. Furthermore, the preferred amount of iron (Fe) containing cobalt (Co) and/or nickel (Ni) as partial substitutes in the principal phase alloy is from 17 to 84% by atomic.

The alloy powder containing an $R_2Fe_{17}$ compound for adjusting the magnet composition must be prepared as such that the R may not exceed 50% by atomic. If R should be contained more than 50% by atomic, problems such as unfavorable oxidation occurs during the preparation of the alloy powder. More preferably, R is incorporated in the alloy powder for adjusting the composition at an amount of from 5 to 35% by atomic. The rest of the powder composition, iron (Fe), preferably accounts for an amount of from 65 to 95% by atomic. Similar to the case of the principal phase alloy powder, a part of the iron (Fe) being incorporated in the alloy powder for adjusting the composition can be substituted by cobalt (Co) and/or nickel (Ni) at an amount as defined above for the principal phase alloy powder.

The alloy powder for adjusting the composition may be prepared by substituting a part of the iron (Fe) being incorporated in the powder by boron (B). An addition of boron (B) at an amount of 6% by atomic or less is allowable because it results in the formation of, besides the $R_2Fe_{17}$ compounds, $R_2Fe_{14}B$ compounds in the alloy powder for adjusting the composition. However, if the addition of boron (B) should exceed 6% by atomic, the B-rich phase which is formed within the alloy powder for adjusting the composition is incorporated in an excess amount in the starting alloy powder material on mixing the alloy powder for adjusting the composition with the principal phase alloy powder. The permanent magnet which results from such a starting alloy powder material suffers inferior magnetic properties. The amount of iron (Fe) containing boron (B) as a partial substitute in the alloy powder for adjusting the composition is preferably in the range of from 59 to 89% by atomic.

The starting alloy powder material thus obtained by mixing the principal phase alloy powder with the alloy powder for adjusting the composition must be size controlled as to yield a pertinent granularity, or a permanent magnet of an inferior quality would result. In particular, only a permanent magnet having a low coercive force (iHc) can be obtained. More specifically, a starting powder material composed of grains less than 1 μm in average diameter would not result in a permanent magnet having superior magnetic properties, because the powder would be severely oxidized in each of the process steps for fabricating the permanent magnet, such as press molding, sintering, and aging steps. If the grains of the starting alloy powder should exceed 80 μm in diameter, the resulting magnet would suffer a low coercive force. It can be seen therefor that the preferred grain size for the starting powder material is from 1 to 80 μm in diameter, and more preferably, from 2 to 10 μm in diameter.

Furthermore, an R—Fe—B permanent magnet of a superior quality having a high residual magnetic flux density (Br) and a high coercive force (iHc) results only from a mixed starting powder material the composition of which is strictly controlled. A preferred starting powder may contain, for example, from 12 to 25% by atomic of an R, from 4 to 10% by atomic of boron (B), from 0.1 to 10% by atomic of cobalt (Co), from 55 to 83.9% by atomic of iron (Fe), and balance unavoidable impurities.

Furthermore, a permanent magnet having not only a further improved temperature characteristics but also high coercive force and corrosion resistance can be obtained by adding, to a principal phase alloy powder containing an $R_2Fe_{14}B$ compound as the principal phase and/or an alloy powder for adjusting the composition containing an $R_2Fe_{17}$ compound, at least one selected from the group consisting of 3.5% by atomic or less of copper (Cu), 2.5% by atomic or less of sulfur (S), 4.5% by atomic or less of titanium (Ti), 15% by atomic or less of silicon (Si), 9.5% by atomic or less of vanadium (V), 12.5% by atomic or less of niobium (Nb), 10.5% by atomic or less of tantalum (Ta), 8.5% by atomic or less of chromium (Cr), 9.5% by atomic or less of molybdenum (Mo), 9.5% by atomic or less of tungsten (W), 3.5% by atomic or less of manganese (Mn), 19.5% by atomic or less of aluminum (A1), 2.5% by atomic or less of antimony (Sb), 7% by atomic or less of germanium (Ge), 3.5% by atomic or less of tin (Sn), 5.5% by atomic or less of zirconium (Zr), 5.5% by atomic or less of hafnium (Hf), 8.5% by atomic or less of calcium (Ca), 8.5% by atomic or less of magnesium (Mg), 7.0% by atomic or less of strontium (Sr), 7.0% by atomic or less of barium ( Ba ) , and 7.0% by atomic or less of beryllium (Be).

By an experiment, a permanent magnet having a magnetic anisotropy was obtained from a starting powder material according to the present invention, and containing, for example, from 12 to 25% by atomic of an R, from 4 to 10% by atomic of boron (B), 30% or less by atomic of cobalt (Co), and from 35 to 84% by atomic of iron (Fe). The resulting permanent magnet yielded excellent magnetic properties such as a coercive force (iHc) higher than 5 kOe, a (BH)max higher than 20 MGOe, and a temperature coefficient of the residual magnetic flux density of 0.1%/° C. or less.

Furthermore, a permanent magnet containing 50% by weight or more of light rare earth elements as the principal component for R yields superior magnetic properties. For instance, permanent magnets containing light rare earth elements and containing from 12 to 20% by atomic of an R, from 4 to 10% by atomic of boron (B), 20% or less by atomic of cobalt (Co), and from 50 to 84% by atomic of iron (Fe) yield extremely superior magnetic properties; in particular, a (BH)max as high as 40 MGOe in maximum was confirmed on those containing at least one of Nd, Pr, and Dy as the R.

As described in the foregoing, the present invention relates to a process for producing a starting powder material for use in the fabrication of sintered R—Fe—B permanent magnets, by adding 70% by weight or less of an alloy powder for adjusting the composition comprising an $R_2Fe_{17}$ compound to a principal phase R—Fe—B alloy powder comprising an $R_2Fe_{14}B$ compound as the principal phase and a B-rich phase (an $R_{1.1}Fe_4B_4$ compound). This process enables production of a starting alloy powder material considerably reduced in contents of the unfavorable B-rich and R-rich phases which impair the magnetic properties of the final magnet, because the starting powder blend allows the B-rich and R-rich compounds in the principal phase alloy powder to react with the $R_2Fe_{17}$ compound being incorporated in the alloy powder for adjusting the composition. Thus, the use of the starting powder material according to the present invention not only enables fabrication of high performance sintered permanent magnets, but also, because of the decreased amount of oxygen being incorporated in the powder, facilitates the fabrication process. Furthermore, by controlling properly the composition of the starting powder blend, R—Fe—B alloy powders for permanent magnets varied in composition can be produced in accordance with diversified needs.

The present invention is illustrated in greater detail referring to non-limiting examples below. It should be understood, however, that the present invention is not to be construed as being limited thereto.

EXAMPLE 1

A principal phase alloy powder was prepared by direct reduction diffusion process as follows.

In a stainless steel vessel was charged a powder mixture obtained by adding 264 g of 99% pure metallic Ca and 49.3 g of anhydrous $CaCl_2$ to 407 g of 98% pure $Nd_2O_3$, 15 g of 99% pure $Dy_2O_3$, 62 g of an Fe—B powder containing 19.1% by weight of boron, and 604 g of 99% pure Fe alloy powder. The powder mixture was then subjected to calcium reduction and diffusion at 1030° C. for 3 hours in an argon gas flow.

The resulting mixed product was cooled and washed with water to remove the residual calcium. The powder slurry thus obtained was subjected to water substitution using an alcohol and the like, and then dried by heating in vacuum to obtain about 1,000 g of principal phase alloy powder.

The resulting alloy powder was composed of grains about 20 μm in average diameter, and contained 14.0% by atomic of neodymium (Nd), 0.8% by atomic of praseodymium (Pr), 0.5% by atomic of dysprosium (Dy), 7.2% by atomic of boron (B), and balance iron (Fe). The oxygen content thereof was 2,000 ppm.

An alloy powder for adjusting the composition and containing an $R_2Fe_{17}$ compound was prepared by an ingot-making and crushing process as follows.

The starting materials, i.e., 124 g of 98% pure metallic neodymium (Nd) and 379 g of 99% pure electrolytic iron were molten in a melting furnace under argon gas atmosphere, and the resulting alloy ingot was crushed by using a jaw crusher and a disk mill to obtain 450 g of an alloy powder.

The alloy powder thus obtained was composed of grains 10 μm in average diameter, and contained 11% by atomic of neodymium (Nd), 0.2% by atomic of praseodymium (Pr), and balance iron (Fe). The oxygen content thereof was 600 ppm. The alloy powder thus obtained was confirmed by EPMA (electron probe microanalysis) and XRD (X-ray diffraction) to consist largely of $Nd_2Fe_{17}$ compound.

The starting alloy powder materials for sintered permanent magnets were obtained from the two alloy powders thus obtained, by mixing predetermined amounts of the alloy powder for adjusting the composition with the principal alloy powder material as shown in Table 1. Besides two types (Nos. 1B and 1C) of alloy powder material according to the present invention, an alloy powder having added therein no alloy powder for adjusting the composition was prepared according to a conventional process for use as a comparative sample (No. 1A).

The alloy powder materials thus obtained were milled by a jet mill and molded under a magnetic field of about 10 kOe, by applying a pressure of about 2 ton/cm$^2$ along a direction vertical to that of the magnetic field to obtain a green compact 15 mm×20 mm×8 mm in size.

The green compact thus obtained was sintered at 1,070° C. for 3 hours in an argon gas atmosphere and then annealed at 500° C. for 2 hours to finally obtain a permanent magnet.

The mixing ratio of the alloy powders, composition of the resulting powder material, and the magnetic properties of the permanent magnets obtained therefrom are summarized in Table 1 below.

TABLE 1

| Sample No. | Mixing ratio of Powders Principal (%) | Adjusting (%) | Composition (atomic %) | Magnetic properties Br (kOe) | iHc (kOe) | $(BH)_{max}$ (MGOe) |
|---|---|---|---|---|---|---|
| 1A | 100 | 0 | 14.0Nd-0.8Pr-0.5Dy-7.2B-balFe | 12.3 | 14.5 | 36.5 |
| 1B | 90 | 10 | 13.7Nd-0.7Pr-0.45Dy-6.5B-balFe | 13.0 | 14.0 | 40.5 |
| 1C | 80 | 20 | 13.4Nd-0.7Pr-0.4Dy-5.8B-balFe | 13.3 | 13.5 | 42.5 |

From the composition of the magnet as summarized in Table 1, the compact ratio of the phases, i.e., $R_2Fe_{14}B$:B-rich phase:R-rich phase (oxides included), can be calculated as follows.

| | |
|---|---|
| No. 1A (Conventional) | 88:3:9, |
| No. 1B (Present Invention) | 91:1.3:7.7, and |
| No. 1C (Present Invention) | 93:0.1:6.9. |

It can be seen that the component ratio of the phases in the final sintered magnet can be controlled arbitrarily by using the alloy powder materials, obtained by adding an alloy powder for adjusting the composition into a principal phase alloy powder according to this present invention. Accordingly, by thus adjusting the composition of the starting powder material, the magnetic properties of the resulting sintered magnet can be considerably improved as compared with those of the magnet obtained by using the directing prepared principal phase alloy powder alone.

EXAMPLE 2

A principal phase alloy powder was prepared by an ingot-making and crushing process in the same manner as that used in preparing the alloy powder for adjusting the composition in Example 1, using 147 g of metallic neodymium (Nd), 23 g of metallic cobalt (Co), 27.5 g of an Fe—B alloy, and 307 g of electrolytic iron. The alloy powder thus obtained contained 12.5% by atomic of neodymium (Nd), 0.2% by atomic of praseodymium (Pr), 5.0% by atomic of cobalt (Co), 6.5% by atomic of boron (B), and 75.8% by atomic of iron (Fe).

The alloy powder for adjusting the composition was prepared by a direct reduction diffusion process in the same manner as that in preparing the principal phase alloy powder in Example 1, from 260 g of $Nd_2O_3$, 80.5 g of $Dy_2O_3$, 43 g of cobalt powder, and 665 g of iron powder, having added therein 190 g of metallic calcium and 23 g of $CaCl_2$. The alloy powder thus obtained contained 10.4% by atomic of neodymium (Nd), 0.1% by atomic of praseodymium (Pt), 3.0% by atomic of dysprosium (Dy), 5.0% by atomic of cobalt (Co), and balance iron (Fe).

Then, an R—Fe—B permanent magnet in the same procedure as that used in Example 1, except for using a starting alloy powder materials obtained by adding 5% by weight of the alloy powder for adjusting the composition prepared above to 95% by weight of the above-obtained principal phase alloy powder. Thus was obtained a magnet containing 12.4% by atomic of neodymium (Nd), 0.2% by atomic of praseodymium (Pr), 0.15% by atomic of dysprosium (Dy), 5% by atomic of cobalt (Co), 6.2% by atomic of boron (B), and balance iron (Fe), which yielded magnetic properties such as a Br of 13.6 KG, an iHc of 11 kOe, and a (BH)max of 45.5 MGOe. Furthermore, the principal phase alloy powder only was used for trial to fabricate a magnet, but it was found that this powder alone cannot be sintered.

EXAMPLE 3

A principal phase alloy powder was prepared by an ingot-making and crushing process in the same manner as in Example 2. The alloy powder thus obtained contained 18% by atomic of neodymium (Nd), 0.8% by atomic of praseodymium (Pr), 2.0% by atomic of dysprosium (Dy), 2% by atomic of Mo (B), and balance iron (Fe).

Similarly, an alloy powder for adjusting the composition comprising an $R_2Fe_{17}$ compound was prepared by an ingot-making and crushing process. The thus obtained alloy powder for adjusting the composition comprising $Nd_2Fe_{17}$ compound contained 9% by atomic of neodymium (Nd), 0.2% by atomic of praseodymium (Pr), 1.0% by atomic of dysprosium (Dy), and balance iron (Fe).

Sintered permanent magnets as shown in Table 2 below were obtained in the same procedure as that used in Example 1, by blending and mixing predetermined amounts of the alloy powder for adjusting the composition with the principal alloy powder material. Besides two types (Nos. 3B and 3C) of alloy powder material according to the present invention, an alloy powder having added therein no alloy powder for adjusting the composition was prepared according to a conventional process for use as a comparative sample (No. 3A). The magnetic properties of the sintered permanent magnets thus obtained are summarized in Table 2 below.

TABLE 2

| Sample No. | Mixing ratio of Powders Principal (%) | Adjusting (%) | Composition (atomic %) | Magnetic properties Br (kOe) | iHc (kOe) | $(BH)_{max}$ (MGOe) |
|---|---|---|---|---|---|---|
| 3A | 100 | 0 | 18.0Nd-0.8Pr-2.0Dy-2.0Mo-10B-balFe | 9.2 | >25 | 20 |
| 3B | 80 | 20 | 16.2Nd-0.7Pr-1.8Dy-1.6Mo-8B-balFe | 9.9 | >25 | 23.5 |
| 3C | 60 | 40 | 14.4Nd-0.5Pr-1.6Dy-1.2Mo-6B-balFe | 11.0 | >25 | 28 |

Table 2 clearly reads that the magnets obtained from the powder materials according to the present invention are superior in magnetic properties Br and (BH)max as compared with a magnet obtained by a conventional process.

EXAMPLE 4

About 1,000 g of a principal phase alloy powder was prepared by a direct reduction diffusion process in the same manner as in Example 1, except for using a mixture obtained by adding 236 g of metallic calcium and 43.7 g of $CaCl_2$ into 400 g of $Nd_2O_3$, 14.3 g of $Dy_2O_3$, 68 g of an Fe—B alloy powder containing 19.1% by weight of boron, and 590 g of an Fe powder. The resulting alloy powder was composed of grains 20 μm in average diameter, and contained 15.0% by atomic of neodymium (Nd), 0.5% by atomic of praseodymium (Pt), 0.5% by atomic of dysprosium (Dy), 8.0% by atomic of boron (B), and balance iron (Fe). The oxygen content thereof was 2,000 ppm.

Furthermore, 450 g. of an alloy powder for adjusting the composition composed of grains 10 μm in average diameter was prepared from 133 g of metallic neodymium (Nd), 6.5 g of metallic dysprosium (Dy), 18.3 g of ferroboron, and 349 g of electrolytic iron by an ingot-making and crushing process in the same procedure as in Example 1.

The alloy powder thus obtained contained 11% by atomic of neodymium (Nd), 0.3% by atomic of praseodymium (Pr), 0.5% by atomic of dysprosium (Dy), 4.0% by atomic of boron (B), and balance iron (Fe). The alloy powder was confirmed by EPMA and XRD to consist mainly of $Nd_2Fe_{17}$ and $Nd_2Fe_{14}B$ compounds. The oxygen content was found to be 600 ppm.

Sintered permanent magnets as shown in Table 3 below were obtained in the same procedure as that used in Example 1, by blending and mixing predetermined amounts of the alloy powder for adjusting the composition with the principal alloy powder material. Besides three types (Nos. 4B, 4C, and 4D) obtained from the alloy powder materials according to the present invention, an alloy powder having added therein no alloy powder for adjusting the composition was prepared according to a conventional process for use as a comparative sample (No. 4A). The magnetic properties of the sintered permanent magnets thus obtained are summarized in Table 3 below.

TABLE 3

| Sample No. | Mixing ratio of Powders Principal (%) | Adjusting (%) | Composition (atomic %) | Magnetic properties Br (kOe) | iHc (kOe) | $(BH)_{max}$ (MGOe) |
|---|---|---|---|---|---|---|
| 4A | 100 | 0 | 15.0Nd-0.5Pr-0.5Dy-8.0B-balFe | 12.0 | 13.6 | 35.0 |
| 4B | 85 | 15 | 14.4Nd-0.5Pr-0.5Dy-7.4B-balFe | 12.6 | 13.2 | 38.5 |
| 4C | 70 | 30 | 13.8Nd-0.4Pr-0.5Dy-6.8B-balFe | 13.0 | 13.2 | 41.0 |
| 4D | 50 | 50 | 13.0Nd-0.4Pr-0.5Dy-6.0B-balFe | 13.5 | 13.0 | 44.0 |

From the composition of the magnet as summarized in Table 3, the component ratio of the phases, i.e., $R_2Fe_{14}B$:B-rich phase:R-rich phase,can be calculated as follows.

| | |
|---|---|
| No. 4A (Conventional) | 85.1:4.4:10.5, |
| No. 4B (Present invention) | 87.3:3.3:8.9, |
| No. 4C (Present invention) | 90.5:2.1:7.4, and |
| No. 4D (Present invention) | 94.1:0.6:5.3. |

It can be seen from Table 3 that the magnets obtained from the starting powder material according to the present invention yield superior Br and (BH)max values as compared with those of a magnet obtained by a conventional process. Furthermore, it can be seen also that magnets having the desired magnetic properties can be readily obtained from the powder material according to the present invention, because the content ratio of the phases in the final sintered magnet can be controlled arbitrarily.

EXAMPLE 5

A principal phase alloy powder was prepared by an ingot-making and crushing process in the same manner as that employed in Example 1, using 128 g of metallic neodymium (Nd), 28.6 g of metallic dysprosium (Dy), 22.8 g of metallic cobalt (Co), 30.4 g of an Fe—B alloy, and 294.6 g of electrolytic iron. The alloy powder thus obtained contained 11% by atomic of neodymium (Nd), 0.3% by atomic of praseodymium (Pr), 2.2% by atomic of dysprosium (Dy), 5.0% by atomic of cobalt (Co), 7.0% by atomic of boron (B), and 74.5% by atomic of iron (Fe).

An alloy powder for adjusting the composition composed of grains 20 μm in average diameter was prepared by a direct reduction diffusion process in the same manner as that in Example 1, from 320 g of $Nd_2O_3$, 63.6g of $Dy_2O_3$, 45.7 g of cobalt powder, 16.2 g of an Fe—B alloy powder, and 620 g of iron powder, having added therein pertinent amounts each of metallic calcium and $CaCl_2$. The alloy powder thus obtained contained 12.5% by atomic of neodymium (Nd), 0.3% by atomic of praseodymium (Pr), 2.2% by atomic of dysprosium (Dy), 2.0% by atomic of boron (B), and 78% by atomic of iron (Fe). The oxygen content of the powder was 2,000 ppm.

Sintered permanent magnets as shown in Table 4 below were obtained in the same procedure as that used in Example 1, by blending and mixing predetermined amounts of the alloy powder for adjusting the composition with the principal alloy powder material. Besides three types (Nos. 5B, 5C, and 5D) obtained from the alloy powder materials according to the present invention, an alloy powder having added therein no alloy powder for adjusting the composition was prepared according to a conventional process for use as a comparative sample (No. 5A). The magnetic properties of the sintered permanent magnets thus obtained are summarized in Table 4 below.

TABLE 4

| Sample No. | Mixing ratio of Powders Principal (%) | Mixing ratio of Powders Adjusting (%) | Composition (atomic %) | Magnetic properties Br (kOe) | Magnetic properties iHc (kOe) | Magnetic properties $(BH)_{max}$ (MGOe) |
|---|---|---|---|---|---|---|
| 5A | 100 | 0 | 11.0Nd-0.3Pr-2.2Dy-5.0Co-7.0B-balFe | 12.0 | 21.5 | 34.0 |
| 5B | 95 | 5 | 11.1Nd-0.3Pr-2.2Dy-5.0Co 6.7B-balFe | 12.1 | 22.0 | 35.2 |
| 5C | 90 | 10 | 11.2Nd-0.3Pr-2.2Dy-5.0 Co-6.5B-balFe | 12.3 | 22.5 | 36.3 |
| 5D | 80 | 20 | 11.3Nd-0.3Pr-2.2Dy-5.0Co-6.0B-balFe | 12.5 | 22.8 | 37.5 |

From the composition of the magnet as summarized in Table 4, the component ratio of the phases, i.e., $R_2Fe_{14}B$:B-rich phase:R-rich phase, can be calculated as follows.

| | |
|---|---|
| No. 5A (Conventional) | 92.9:2.3:4.8, |
| No. 5B (Present invention) | 93.1:1.9:5.0, |
| No. 5C (Present invention) | 93.4:1.4:5.2, and |
| No. 5D (Present invention) | 94.0:0.5:5.5. |

It can be seen from the results in Table 4 that the magnets obtained from the starting powder material according to the present invention yield superior Br, iHc, and (BH)max values as compared to those of a magnet obtained by a conventional process. Furthermore, it can be seen also that magnets having desired magnetic properties can be readily obtained from the powder material according to the present invention, because the component ratio of the phases in the final sintered magnet can be controlled arbitrarily.

While the invention has been described in detail and with reference to specific examples thereof, it will be apparent to one skilled in the art that various changes and modifications can be made therein without departing from the spirit and scope thereof.

What is claimed is:

1. A process for producing a starting alloy powder material for fabricating an R—Fe—B permanent magnet, characterized by that an alloy powder comprising an $R_2Fe_{17}$ phase for adjusting the composition and containing 50% by atomic or less of R (where R represents at least one selected from rare earth elements inclusive of yttrium) and balance iron (where at least one of cobalt and nickel may be present as a partial substitute for iron) with unavoidable impurities is added to a principal phase alloy powder which comprises an $R_2Fe_{14}B$ phase as the principal phase and containing from 10 to 30% by atomic of R (where R represents at least one of rare earth elements inclusive of yttrium), from 6 to 40% by atomic of boron, and balance iron (where at least one of cobalt and nickel may be present as a partial substitute for iron) with unavoidable impurities.

2. A process for producing a starting alloy powder material for fabricating an R—Fe—B permanent magnet as claimed in claim 1, wherein the alloy powder for adjusting the composition is added to be mixed with the principal phase alloy powder at an amount of 70% by weight or less with respect to the total weight of said starting alloy powder material.

3. A process for producing a starting alloy powder material for fabricating an R—Fe—B permanent magnet as claimed in claim 2, wherein the alloy powder for adjusting the composition is added to be mixed with the principal phase alloy powder at an amount of from 0.1 to 40% by weight with respect to the total weight of said starting alloy powder material.

4. A process for producing a starting alloy powder material for fabricating an R—Fe—B permanent magnet as claimed in claim 1, wherein the content of the element R in the principal phase alloy powder is in the range of from 12 to 20% by atomic.

5. A process for producing a starting alloy powder material for fabricating an R—Fe—B permanent magnet as claimed in claim 1, wherein the content of boron in the principal phase alloy powder is in the range of from 6 to 20% by atomic.

6. A process for producing a starting alloy powder material for fabricating an R—Fe—B permanent magnet as claimed in claim 1, wherein the content of iron in the principal phase alloy powder is in the range of from 30 to 84% by atomic.

7. A process for producing a starting alloy powder material for fabricating an R—Fe—B permanent magnet as claimed in claim 6, wherein the content of iron in the principal phase alloy powder is in the range of from 60 to 82% by atomic.

8. A process for producing a starting alloy powder material for fabricating an R—Fe—B permanent magnet as claimed in claim 1, wherein cobalt as a partial substitute for iron is incorporated in the principal phase alloy powder at an amount of 10% or less by atomic.

9. A process for producing a starting alloy powder material for fabricating an R—Fe—B permanent magnet as claimed in claim 1, wherein nickel as a partial substitute for iron is incorporated in the principal phase alloy powder at an amount of 3% or less by atomic.

10. A process for producing a starting alloy powder material for fabricating an R—Fe—B permanent magnet as claimed in claim 1, wherein the amount of iron containing at least one selected from cobalt and nickel as a partial substitute therefor is incorporated in the principal phase alloy powder at an amount of from 17 to 84% by atomic.

11. A process for producing a starting alloy powder material for fabricating an R—Fe—B permanent magnet as claimed in claim 1, wherein the content of the element R in the alloy powder for adjusting the composition is in the range of from 5 to 35% by atomic.

12. A process for producing a starting alloy powder material for fabricating an R—Fe—B permanent magnet as claimed in claim 1, wherein the content of iron in the alloy powder for adjusting the composition is in the range of from 65 to 95% by atomic.

13. A process for producing a starting alloy powder material for fabricating an R—Fe—B permanent magnet as claimed in claim 1, wherein iron in the alloy powder for adjusting the composition is partially substituted by 6% by atomic of boron.

14. A process for producing a starting alloy powder material for fabricating an R—Fe—B permanent magnet as claimed in claim 1, wherein the principal phase alloy powder and the alloy powder for adjusting the composition are each prepared by an ingot-making and crushing process or a direct reduction diffusion process.

15. A process for producing a starting alloy powder material for fabricating an R—Fe—B permanent magnet as claimed in claim 1, wherein the amount of iron containing boron as a partial substitute therefor is incorporated in the alloy powder for adjusting the composition at an amount of from 59 to 89% by atomic.

16. A process for producing a starting alloy powder material for fabricating an R—Fe—B permanent magnet as claimed in claim 1, wherein at least one of the powders selected from the group consisting of a principal phase alloy powder and an alloy powder for adjusting the composition containing at least one selected from the group consisting of 3.5% by atomic or less of copper (Cu), 2.5% by atomic or less of sulfur (S), 4.5% by atomic or less of titanium (Ti), 15% by atomic or less of silicon (Si), 9.5% by atomic or less of vanadium (V), 12.5% by atomic or less of niobium (Nb), 10.5% by atomic or less of tantalum (Ta), 8.5% by atomic or less of chromium (Cr), 9.5% by atomic or less of molybdenum (Mo), 7.5% by atomic or less of tungsten (W), 3.5% by atomic or less of manganese (Mn), 19.5% by atomic or less of aluminum (A1), 2.5% by atomic or less of antimony (Sb), 7% by atomic or less of germanium (Ge), 3.5% by atomic or less of tin (Sn), 5.5% by atomic or less of zirconium (Zr), 5.5% by atomic or less of hafnium (Hf), 8.5% by atomic or less of calcium (Ca), 8.5% by atomic or less of magnesium (Mg), 7.0% by atomic or less of strontium (Sr), 7.0 by atomic or less of barium (Ba), and 7.0% by atomic or less of beryllium (Be).

17. A process for producing a starting alloy powder material for fabricating an R—Fe—B permanent magnet as claimed in claim 1, wherein the alloy powder material contains from 12 to 25% by atomic of an element R, from 4 to 10% by atomic of boron (B), from 0.1 to 10% by atomic of cobalt (Co), and from 68 to 80% by atomic of iron (Fe).

18. A process for producing a starting alloy powder material for fabricating an R—Fe—B permanent magnet as claimed in claim 1, wherein the alloy powder material comprises powder particles whose average size is from 2 to 80 μm.

19. A process for producing a starting alloy powder material for fabricating an R—Fe—B permanent magnet as claimed in claim 18 wherein the alloy powder material comprises powder particles whose average size is from 2 to 10 μm.

* * * * *